US010066797B1

(12) United States Patent
Tan

(10) Patent No.: US 10,066,797 B1
(45) Date of Patent: Sep. 4, 2018

(54) CONVENIENT-TO-INSTALL LED DOWNLIGHT

(71) Applicant: Treasure Best Ltd., Dongguan, Guangdong Province (CN)

(72) Inventor: Yiyi Tan, Dongguan (CN)

(73) Assignee: Treasure Best Ltd., Dongguan (CN)

( * ) Notice: Subject to any disclaimer, the term of this patent is extended or adjusted under 35 U.S.C. 154(b) by 0 days.

(21) Appl. No.: 15/599,544

(22) Filed: May 19, 2017

(51) Int. Cl.

| | |
|---|---|
| ***F21S 8/02*** | (2006.01) |
| ***F21V 14/04*** | (2006.01) |
| ***F21V 14/02*** | (2006.01) |
| ***F21V 29/76*** | (2015.01) |
| ***F21V 29/502*** | (2015.01) |
| ***F21V 19/00*** | (2006.01) |
| ***F21V 21/04*** | (2006.01) |
| *F21Y 115/10* | (2016.01) |

(52) U.S. Cl.
CPC ..... *F21S 8/02* (2013.01); *F21V 14/02* (2013.01); *F21V 14/04* (2013.01); *F21V 19/003* (2013.01); *F21V 21/044* (2013.01); *F21V 29/502* (2015.01); *F21V 29/763* (2015.01); *F21Y 2115/10* (2016.08)

(58) Field of Classification Search
CPC .. F21S 8/02; F21V 14/02; F21V 14/04; F21V 29/502; F21V 29/763; F21V 19/003; F21V 21/044
See application file for complete search history.

(56) References Cited

U.S. PATENT DOCUMENTS

2009/0086476 A1* 4/2009 Tickner ..... F21S 8/02 362/231
2014/0268767 A1* 9/2014 Hatch ..... F21V 15/01 362/249.02

* cited by examiner

*Primary Examiner* — Thomas M Sember
(74) *Attorney, Agent, or Firm* — Alan D. Kamrath; Kamrath IP Lawfirm, P.A.

(57) ABSTRACT

A convenient-to-install LED downlight includes a cylinder, a light source device, a light diverging assembly, a cover assembly and a power supply device. The light source device is installed to the top of the cylinder, and the light diverging assembly is installed at the bottom of the light source device and disposed inside the cylinder. The cover assembly is disposed inside the cylinder and under the light source device. The power supply device is engaged with the top of the light source device capable of producing a deflection with respect to the light source device to form a straight line, so that the power supply device passes through and enters into an installing hole of the ceiling and then deflects to its original position and a support bracket at the bottom abuts the ceiling. The LED downlight has the features of simple structure and convenient installation.

13 Claims, 10 Drawing Sheets

CONVENIENT-TO-INSTALL LED DOWNLIGHT

BACKGROUND OF THE INVENTION

Field of the Invention

The present invention relates to an LED downlight and, more particularly, to the LED downlight that can be installed very conveniently.

Description of the Related Art

In general, a conventional downlight primarily installs a high-power incandescent or fluorescent light, so that its application consumes more energy, and it no longer complies with the energy-saving and carbon reduction requirements. As technologies advance, different countries promote the concept of energy saving and environmental protection, so that most of the present downlights adopt a new-generation LED light source which can save more than 80% of the energy for the same or equivalent lighting effect. The service life of the LED light source is much longer than the service life of the incandescent or fluorescent light, and the LED light source is definitely the best light source for various different lamps. Although the present downlights also adopt the LED light source, the whole structural assembly still has the drawbacks of complicated structure and inconvenient installation.

SUMMARY OF THE INVENTION

To overcome the drawbacks of the conventional structure, a convenient-to-install LED downlight is provided in accordance with the present invention.

Therefore, it is a primary objective of the present invention to overcome the drawbacks of the prior art by providing an LED downlight with simple structure and convenient installation.

To achieve the aforementioned objectives, the present invention provides a convenient-to-install LED downlight comprising a cylinder, a light source device, a light diverging assembly, a cover assembly and a power supply device.

The cylinder is a downwardly covered cylindrical object having an inwardly hollow bottom to form a containing space, a center hole formed at the center of the top of the cylinder, two or more slots formed on an inner surface of the top of the cylinder and disposed around the center hole, and two or more mounting holes formed on an outer wall of the cylinder and provided for latching an elastic plate.

The light source device comprises a heat sink, an LED light source, a support frame and a top cover. The heat sink is engaged with the top of the cylinder, and the LED light source is supported by the support frame and engaged with a bottom surface of the heat sink bottom surface, so that the LED light source stays in the center hole at the center of the top of the cylinder. The top of the top cover has two erected engaging walls each having an engaging hole, and the top cover is engaged with the top of the heat sink.

The light diverging assembly comprises a fixed cylinder and a light diverging element. The top and bottom of the fixed cylinder are inwardly hollow to form a containing space. A shield wall is reserved at the bottom periphery of the fixed cylinder, and two or more buckles are extendedly outwardly from the outer wall of the top of the fixed cylinder. The light diverging element is contained in the containing space of the fixed cylinder. The bottom periphery abuts the shield wall, and the fixed cylinder is installed into the containing space of the cylinder. The buckle of the fixed cylinder is passed through the slot of the cylinder to define a latching connection.

The cover assembly comprises a fixing ring, a reflector and an elastic plate. The fixing ring has a flat ring disk, the middle is erected upwardly to form a vertical wall, and the interior is penetrated to form a large through hole. A support wall formed at the bottom edge is the external surface of the reflector, and the center is penetrated to form a light output hole. At least two opposite engaging walls are formed on the external surface, and the elastic plate has a length and is locked onto the engaging wall. The reflector is accommodated into a large through hole of the fixing ring, such that the support wall supports the bottom edge of the vertical wall of the fixing ring. Both edges of the elastic plate are bent inwardly to abut the inner wall of the vertical wall of the fixing ring during the process. The cover assembly is inserted into the containing space of the cylinder, so that the joint between the ring disk of the fixing ring and the vertical wall is latched and fixed to the bottom edge of the cylinder.

The power supply device comprises a housing, a bottom cover, a drive power supply and a support bracket. The housing is a box-shaped housing, the bottom surface is hollow, the bottom of an end is partially withdrawn upwardly, and each of the two sidewalls of the end has an engaging hole for passing a connecting element to engage with the engaging hole of the engaging wall of the top cover. The bottom cover is engaged with the bottom surface of the housing. The drive power supply is installed inside the housing, and the drive power supply is electrically coupled to the LED light source through an electric wire. The support bracket is locked to the bottom surface of the bottom cover. The power supply device is deflected upwardly by using the connecting element engaged with the top cover as the axis, so that the power supply device is in an erected status with respect to the top cover.

In the convenient-to-install LED downlight, the mounting hole formed on an outer wall of the cylinder has at least two hole positions of different heights for selectively latching the elastic plate to a position of a different height.

In the convenient-to-install LED downlight, the light diverging element is a lens or a reflective cup.

In the convenient-to-install LED downlight, the top of the reflector is installed with a glass plate additionally. The glass plate is horizontally disposed at an opening of the top of the reflector and then locked onto the engaging wall and a wall connected to the reflector by passing a group of locking elements through a group of pressing plates respectively to force the glass plate and the reflector to be engaged and positioned.

In the convenient-to-install LED downlight, the fixing ring and the reflector are in any shape.

In the convenient-to-install LED downlight, the power supply device further comprises a thermostat and a ground wire. The thermostat is installed inside the housing, and the ground wire is coupled to an outer wall of the housing.

In the convenient-to-install LED downlight, the support bracket of the power supply device has a curved arc to enhance elasticity.

In the convenient-to-install LED downlight, when the power supply device is deflected upwardly into an erected status, the whole downlight may be passed upwardly into an installing hole reserved in the ceiling, and the elastic plate of the cylinder and the support bracket of the power supply device are dodged into the installing hole due to deflection and deformation during the process. After the cylinder is engaged with the installing hole, the power supply device will be deflected downwardly to its original position due to gravity, while the support bracket inside the ceiling will downwardly touch the ceiling, so that the power supply device will stay in a transverse direction and prevent the whole downlight from displacing by gravity.

In the convenient-to-install LED downlight, the downlight is installed to a first bracket assembly, and the first bracket assembly comprises a fixed board, a male slider, a female slider and a positioning bolt. A penetrating hole is formed on a surface of the fixed board and provided for installing the cylinder of the downlight into the penetrating hole. The elastic plate of the cylinder is extended outwardly to latch with the fixed board. The support bracket of the power supply device abuts the fixed board, so that the whole downlight is installed to the fixed board securely. A slot is formed on both side edges of the fixed board separately. The female slider is inserted from an end into the slots on both side edges of the fixed board, and the male slider is then inserted from the other end into the corresponding female slider. The male slider and the female slider may be moved and stretched with respect to each other to adjust and select an appropriate total length. After the positioning bolt is passed through the male slider and the female slider, the positioning bolt is locked and fixed to the fixed board to limit the relative position among the fixed board, the male slider and the female slider.

In the convenient-to-install LED downlight, the downlight is installed to a second bracket assembly. The second bracket assembly comprises a fixing ring, a shelf plate, an elastic plate, a positioning bolt, a slider, a junction box and a connecting plate. The shelf plate has a root portion engaged with two opposite sides of the fixing ring separately, so that a plate body of the shelf plate is in an erected status. The plate body of the shelf plate has a longitudinal groove formed thereon, and the positioning bolt is passed and installed into the longitudinal groove to lock the plate body of the elastic plate to the plate body of the shelf plate. A high/low position in the longitudinal groove may be adjusted. Both sides of each elastic plate have an outwardly extended oblique wing plate, and each oblique wing plate has a slot formed thereon. The slider is passed through the slot formed on the oblique wing plate of the same elastic plate, and the junction box is fixed with the fixing ring by the connecting plate. The downlight is installed in the fixing ring, and the elastic plate extending out from the mounting hole of the cylinder is latched with the fixing ring.

In the convenient-to-install LED downlight, the junction box comprises a box body, a side plate, a wire snapping plate and an elastic plate. The box body is engaged with the connecting plate, and the wire snapping plate is installed inside the box body. The side plate is installed on the front and rear sides of the box body. A latch plate of a side of the side plate abuts a latch hole on a side of the box body to achieve a latching effect, and the other side of the side plate is latched to a side surface of the box body by the elastic plate.

Compared with the prior art, the present invention has the following advantages and effects:

1. The power supply device in the LED downlight of the present invention can be deflected with respect to the top cover, which can be deflected for 90 degrees to align linearly with the cylinder when the LED downlight is installed, so that the power supply device can be passed and entered quickly from the installing hole formed on the ceiling, and while the LED downlight can pass through the support bracket at the bottom of the power supply device and abut the ceiling. Therefore, the present invention has the features of simple structure and convenient installation.

2. The LED downlight of the present invention may use a first bracket assembly for household lighting or a second bracket assembly for commercial lighting, and the light output angle of the lens or the reflective cup can be changed to meet different requirements of lighting up an object. In addition, the LED light source with different color temperatures can meet the requirement of emitting different color lights, and different types of cover assemblies may be provided for users to select a specific position for the installation of the LED downlight.

DETAILED DESCRIPTION OF THE PREFERRED EMBODIMENTS

The technical characteristics, contents, advantages and effects of the present invention will be apparent with the detailed description of preferred embodiments accompanied with related drawings as follows.

Figure 1:
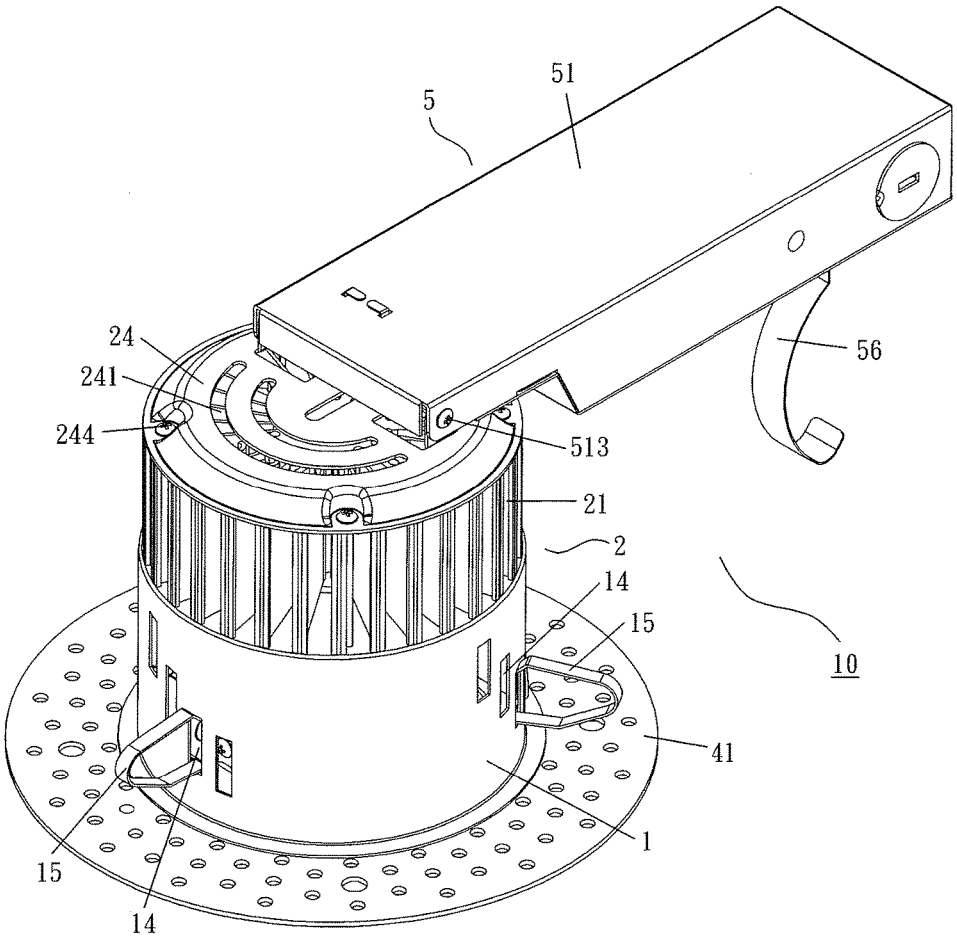
FIG. 1 is a perspective view of an LED downlight of the present invention.
Figures 2, 3:
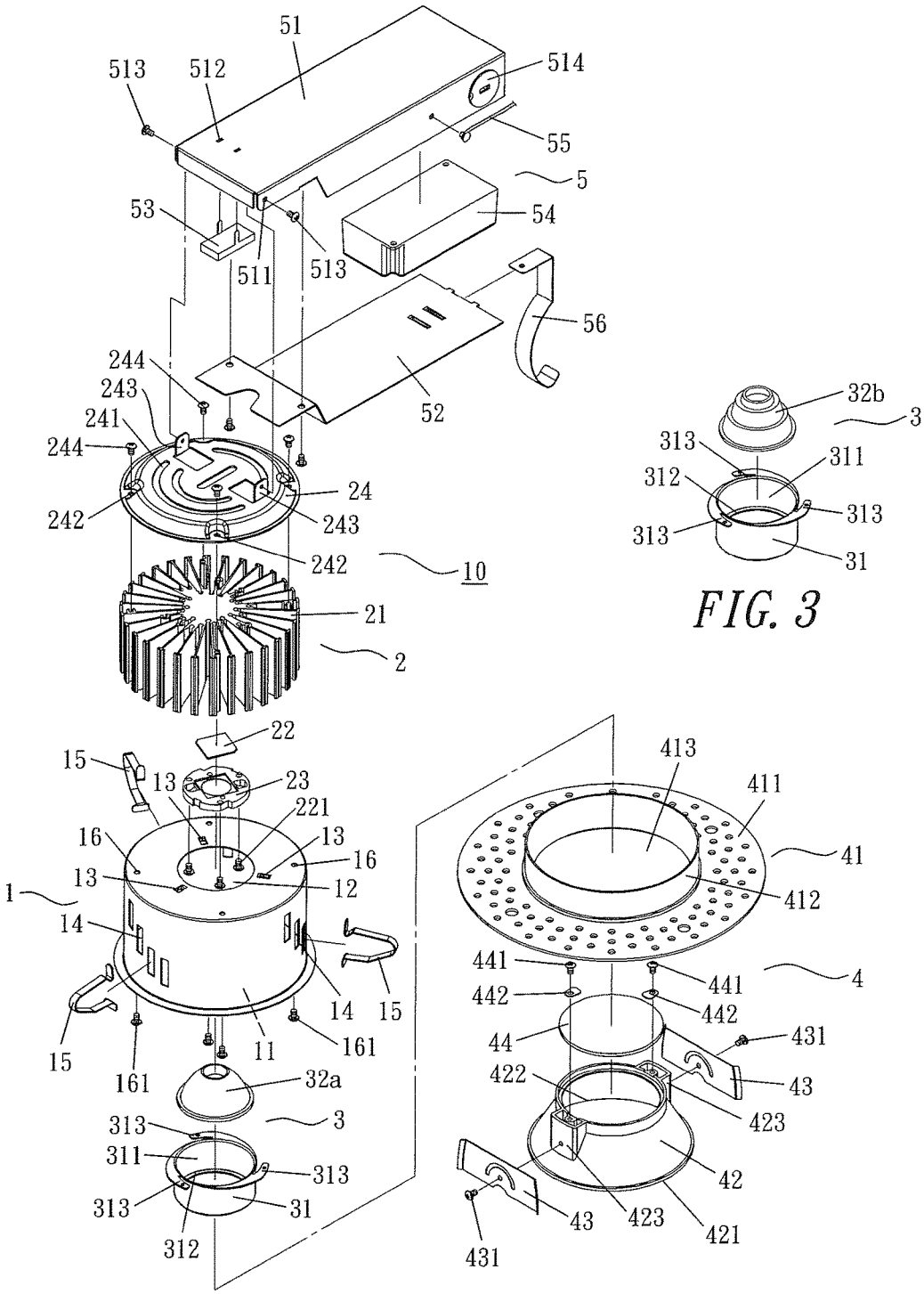
FIG. 2 is an exploded view of an LED downlight of the present invention.
FIG. 3 is an exploded view showing some of the components of an LED downlight of the present invention.

With reference to FIGS. 1 and 2 for a convenient-to-install LED downlight in accordance with a preferred embodiment of the present invention, the LED downlight 10 comprises a cylinder 1, a light source device 2, a light diverging assembly 3, a cover assembly 4 and a power supply device 5.

The cylinder 1 is a downwardly covered cylindrical object having an inwardly hollow bottom to form a containing space 11, a center hole 12 formed at the center of the top of the cylinder 1, two or more slots 13 (preferably three slots 13) formed on an inner surface of the top of the cylinder 1 and disposed around the center hole 12, and two or more mounting holes 14 formed on an outer wall of the cylinder and provided for latching an elastic plate 15. The quantity of mounting holes is preferably equal to three, and these three mounting holes are arranged symmetrically with respect to the center. Each group of mounting holes 14 has at least two hole positions of different heights provided for selectively latching the elastic plate 15 to the mounting hole 14 at a different height as needed, but different groups of elastic plates 15 must be latched to the mounting holes 14 of the same height. The cylinder 1 has a plurality of through holes 16 (preferably four through holes 16) formed around the top of the cylinder 1, and the through holes 16 are provided for passing a connecting element 161 (such as a bolt) to lock and engage with other components (which will be described later).

The light source device 2 comprises a heat sink 21, an LED light source 22, a support frame 23 and a top cover 24. The heat sink 21 has a plurality of radially arranged fins with a penetrating hole formed at the center of the fins, and a plurality of engaging holes formed at the top and bottom surfaces of the fins. The cylinder 1 is passed through the corresponding through hole 16 and locked with the engaging hole reserved on the outer periphery of the bottom surface of the heat sink 21 by the connecting element 161 (such as a bolt), so that the heat sink 21 is locked and engaged with the top of the cylinder 1. The LED light source 22 is supported by the support frame 23, and a plurality of connecting elements 221 (such as bolts) is passed through the support frame 23 and locked to the engaging hole reserved at the inner periphery of the bottom surface of the heat sink 21, so that the LED light source 22 stays precisely in the center hole 12 at the center of the top of the cylinder 1. The top cover 24 is a disc object having a plurality of arc ventilation slots 241 reserved at the top of the top cover 24, a plurality of engaging holes 242, and two erected engaging walls 243 with each having an engaging hole. The top cover 24 is locked to the corresponding engaging hole 242 reserved on the top of the heat sink 21 by passing a plurality of connecting elements 244 (such as bolt) through the engaging holes 242 respectively to assemble the heat sink 21, the LED light source 22, the support frame 23 and the top cover 24 into a light source device 2. During the assembling process, the positive and negative electrodes of the LED light source 22 must be aligned precisely with the positive and negative electrodes of the support frame 23, and the positive and negative electrodes of the support frame 23 are electrically coupled through a power cable and a power supply (which will be described later). When the LED light source 22 emits an LED light downwardly, the light will pass through a through hole at the center of the support frame 23 without any hindrance. When the LED light source 22 emits light, the heat generated will be conducted from the heat sink 21 to the surrounding and dissipated to the outside, and the back side of the LED light source 22 is coated with a thermal glue to improve the heat dissipating speed of the LED light source 22. The engaging wall 243 on the top cover 24 will be engaged with the power supply device 5.

Figure 4:
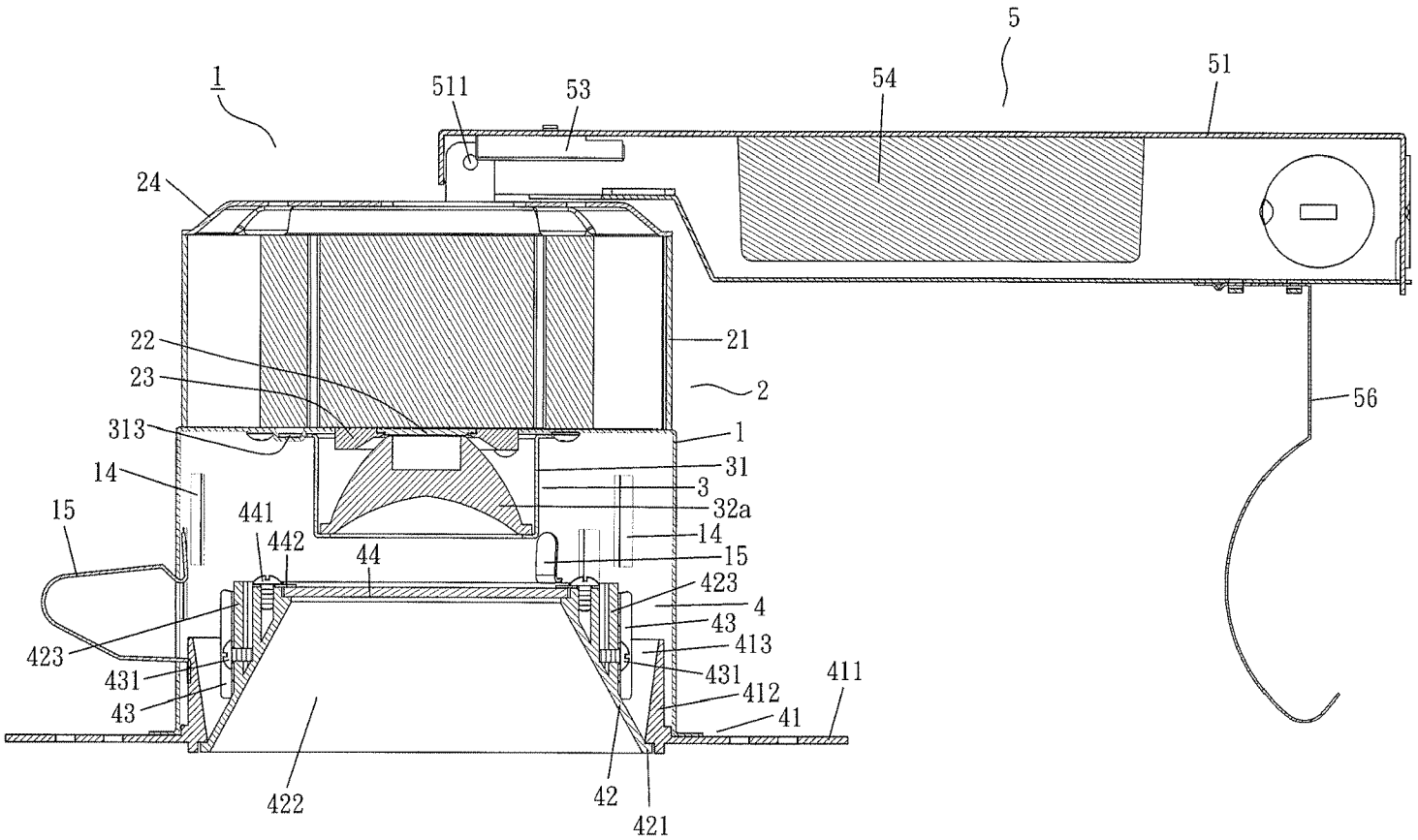
FIG. 4 is a cross-sectional view of a lens selected for a light diverging element of an LED downlight of the present invention.
Figure 5:
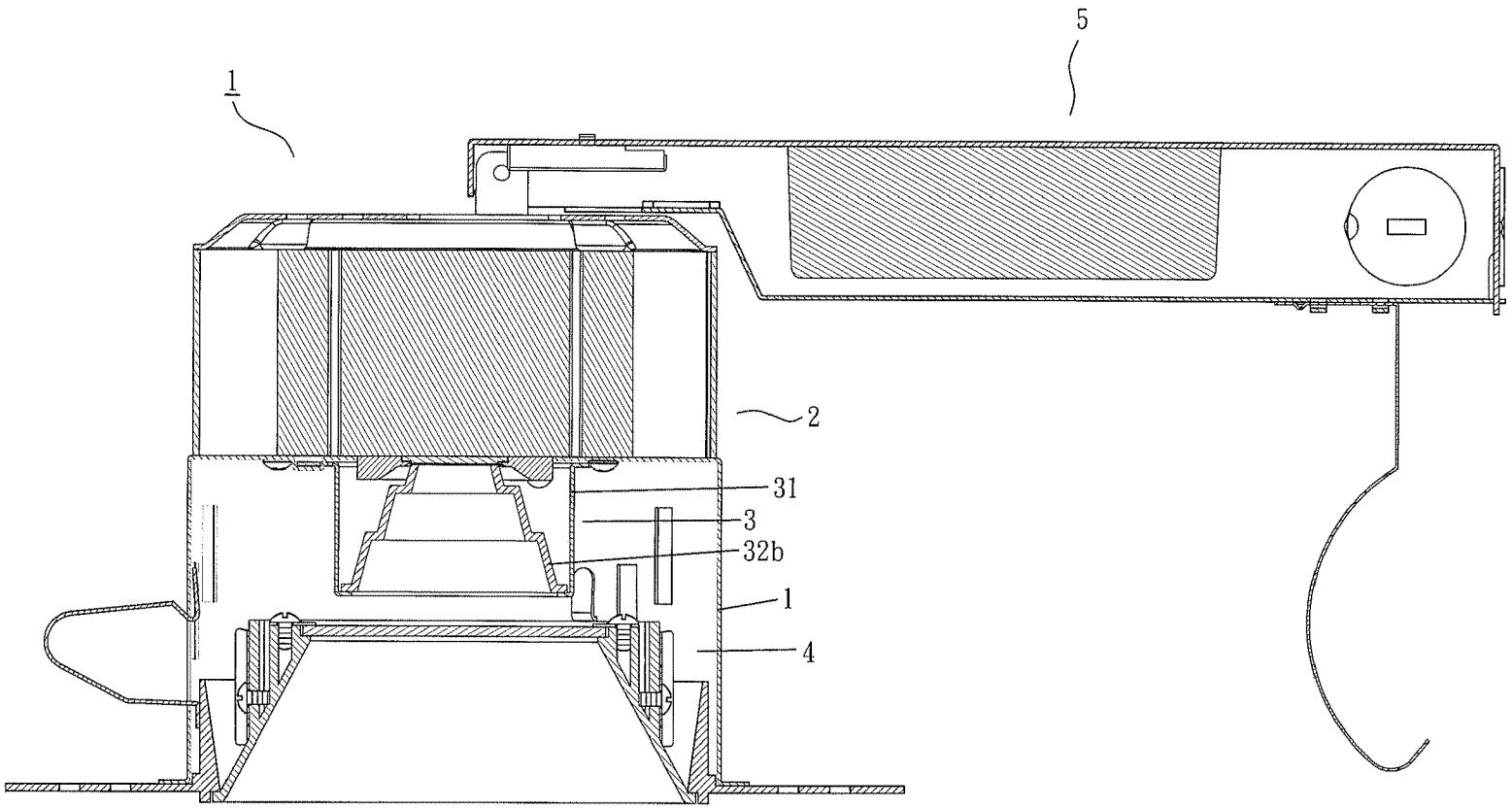
FIG. 5 is a cross-sectional view of a reflective cup selected for a light diverging element of an LED downlight of the present invention.

The light diverging assembly 3 is comprised of a fixed cylinder 31 and a light diverging element. The light diverging element may be selected as a lens 32*a* or a reflective cup 32*b* as needed. In other words, either the lens 32*a* or the reflective cup 32*b* is a light diverging element. The light diverging assembly 3 is comprised of a fixed cylinder 31 and a lens 32*a* as shown in FIGS. 2, 4 or the light diverging assembly 3 is comprised of a fixed cylinder 31 and a reflective cup 32*b* as shown in FIGS. 3, 5. Both of the top and the bottom of the fixed cylinder 31 are inwardly hollow to form a containing space 311, but a shield wall 312 is reserved at the bottom periphery of the fixed cylinder 31, and a plurality of buckles 313 is extend outwardly and upwardly with a small angle from the outer wall of the top of the fixed cylinder 31. The quantity of buckles 313 corresponds to the quantity of slots 13 of the cylinder 1, and the quantity is preferably equal to three. During assembling, the light diverging element (either the lens 32*a* or the reflective cup 32*b*) is contained in the containing space 311 of the fixed cylinder 31, and the bottom periphery of the light diverging element (either the lens 32*a* or the reflective cup 32*b*) precisely abuts the shield wall 312. Then, the whole light diverging assembly 3 is installed inside the containing space 11 of the cylinder 1. In the meantime, the buckle 313 of the fixed cylinder 31 is passed through the corresponding slot 13 of the cylinder 1, and the fixed cylinder 31 is rotated, so that the buckle 313 is latched closely with the corresponding slot 13. The fixed cylinder 31 accommodates the light diverging element and then latches closely with the bottom surface of the top of the cylinder 1 (as shown in FIGS. 4, 5). Since the lens 32*a* or the reflective cup 32*b* may have a different light diverging angle, the lens 32*a* or the reflective cup 32*b* may be selected for the application. If it is necessary to replace the lens 32*a* or reflective cup 32*b*, users will rotate the fixed cylinder 31 in a reverse direction. The buckle 313 is loosened from the corresponding slot 13 gradually, until the fixed cylinder 31 is detached from the cylinder 1, and the lens 32*a* or the reflective cup 32*b* may be removed from the fixed cylinder 31 for replacement, change or maintenance. Then, the components are reinstalled according to the aforementioned installation procedure.

Figure 6:
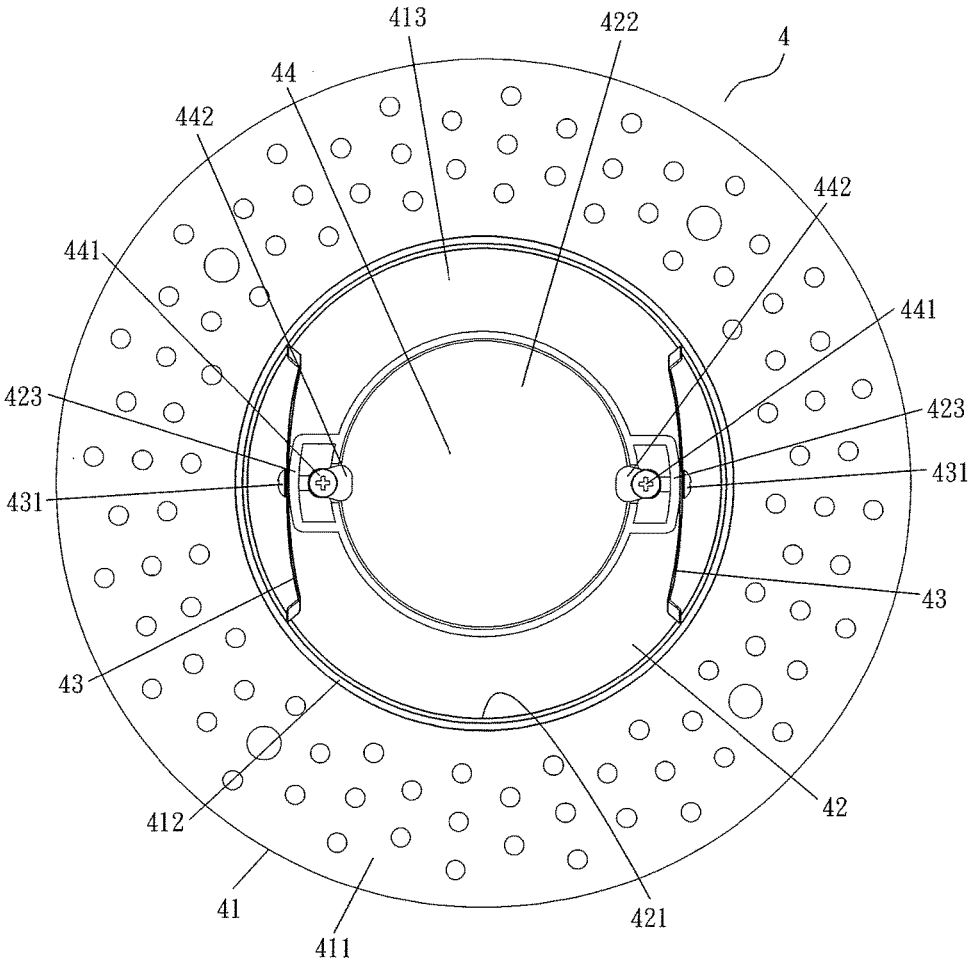
FIG. 6 is a top view of a cover assembly in an LED downlight of the present invention.

The cover assembly 4 comprises a fixing ring 41, a reflector 42 and an elastic plate 43. The fixing ring 41 is a flat ring disk 411 with a vertical wall 412 erected from the middle, and a large through hole 413 vertically penetrating through the fixing ring 41. The reflector 42 is a tapered conical object with a support wall 421 formed at the bottom edge of the external surface of the reflector 42, and the center is vertically penetrated to form a substantially conical light output hole 422. The external surface of the reflector 42 has two opposite erected engaging walls 423, and the elastic plate 43 comes with a specific length and a specific quantity of at least two. A connecting element 431 (such as a bolt) is provided for locking the corresponding engaging wall 423. During assembling, both sides of the reflector 42 are locked to the elastic plate 43 and then put in from top to bottom through the large through hole 413 of the fixing ring 41, until the support wall 421 of the reflector 42 upwardly supports the bottom edge of the vertical wall 412 of the fixing ring 41. During the process, both side edges of the elastic plate 43 must be bent inwardly to produce an appropriate deformation, to abut an inner wall of the vertical wall 412 of the fixing ring 41 (as shown in FIG. 6). In other words, the reflector 42 is bent and pressed by the elastic plate 43 and combined with the fixing ring 41 to form the cover assembly 4. Then, the cover assembly 4 is inserted from the bottom of the cylinder 1 into the containing space 11 of the cylinder 1, and latched and fixed to the bottom edge of the cylinder 1 by the joint between the flat ring disk 411 of the fixing ring 41 and the vertical wall 412 (as shown in FIGS. 4 and 5). The top of the reflector 42 may or may not be installed additionally with a glass plate 44. If the glass plate 44 is installed additionally, the shape of the glass plate 44 must be the same or slightly larger than the top opening of the reflector 42, so that the glass plate 44 can be placed horizontally at the top opening of the reflector 42. Then, a group of locking elements 441 (such as bolts) are passed and installed to a group of pressing plates 442 to lock the engaging wall 423 and a wall of the reflector 42 respectively (as shown in FIG. 6). The group of pressing plates 442 presses and forces the glass plate 44 and the reflector 42 to be engaged and positioned. It is noteworthy that both of the fixing ring 41 and the reflector 42 have a circular shaped appearance in this preferred embodiment. However, the fixing ring 41 and the reflector 42 are not limited to the circular shape only, and they may be of any shape in other embodiments.

The power supply device 5 comprises a housing 51, a bottom cover 52, a thermostat 53, a drive power supply 54, a ground wire 55 and a support bracket 56. The housing 51 is a box-shaped housing with a hollow bottom surface, and an end of bottom of the housing 51 is partially and upwardly withdrawn. Each of the two sidewalls at the end has an engaging hole 511 and a group of slots 512 formed at the top provided for passing a connecting element 513 (such as a bolt) to lock the corresponding engaging hole formed on the engaging wall 243 of the top cover 24, to engage the whole power supply device 5 to the top of the top cover 24. Each of the two sidewalls at the other end of the housing 51 has a counterbore 514 provided for latching a protective cover and connect a protective hose covered on an electric wire. Therefore, the electric wire passes through the protective hose and enters into the housing 51 to receive power. A counterbore 514 on the other side is provided for another protective tube covered onto an electric wire to output power, and the bottom cover 52 may be completely attached and locked to the bottom surface of the housing 51. The thermostat 53 is plugged and positioned into the slot 512 of the housing 51, and the drive power supply 54 is installed inside the housing 51 and electrically coupled to the thermostat 53 and the LED light source 22 through an electric wire. The ground wire 55 is coupled to the outer wall of the housing 51, and the support bracket 56 has a curved arc to enhance the elasticity and is locked to the bottom surface of the bottom cover 52. The thermostat 53 provides a protection for overheat or power failure. Any appropriate thermostat may be selected for the installation according to the actual testing temperature, to ensure the disconnection of the power supply and the safety of use when the LED downlight 10 is abnormal. The shape, size, output power and output current of the drive power supply 54 complies with the actual requirements, so that the LED downlight 10 can provide a dimming function, a long service life, high power and a flicker-free effect. During assembling, the thermostat 53 and the drive power supply 54 are installed at predetermined installation positions inside the housing 51 respectively, an electric wire is connected, and the bottom cover 52 is attached and locked to the bottom surface of the housing 51 to complete assembling the power supply device 5.

In the assembling of the whole LED downlight 10, the heat sink 21, the LED light source 22, the support frame 23 and the top cover 24 are assembled into the light source device 2, and the cylinder 1 is engaged with the bottom surface of the heat sink 21, so that the LED light source 22 stays in the center hole 12 formed at the center of the top of the cylinder 1. Then, the light diverging assembly 3 is installed into the containing space 11 of the cylinder 1, such that the light diverging assembly 3 is latched closely to the bottom surface of the top of the fixed cylinder 31. In the meantime, the engaging hole 511 reserved on the two sidewalls of an end of the power supply device 5 is aligned precisely with the engaging hole formed on the engaging wall 243 of the top cover 24, and the connecting element 513 (such as a bolt) is passed and provided for the corresponding locking connection, so that the whole power supply device 5 is engaged with the top of the top cover 24. Finally, the cover assembly 4 is inserted into the containing space 11 of the cylinder 1 from the bottom of the cylinder 1, and the cover assembly 4 is latched and fixed to the bottom edge of the cylinder 1, to complete assembling the whole LED downlight 10 as shown in FIGS. 4 and 5.

Figure 7:
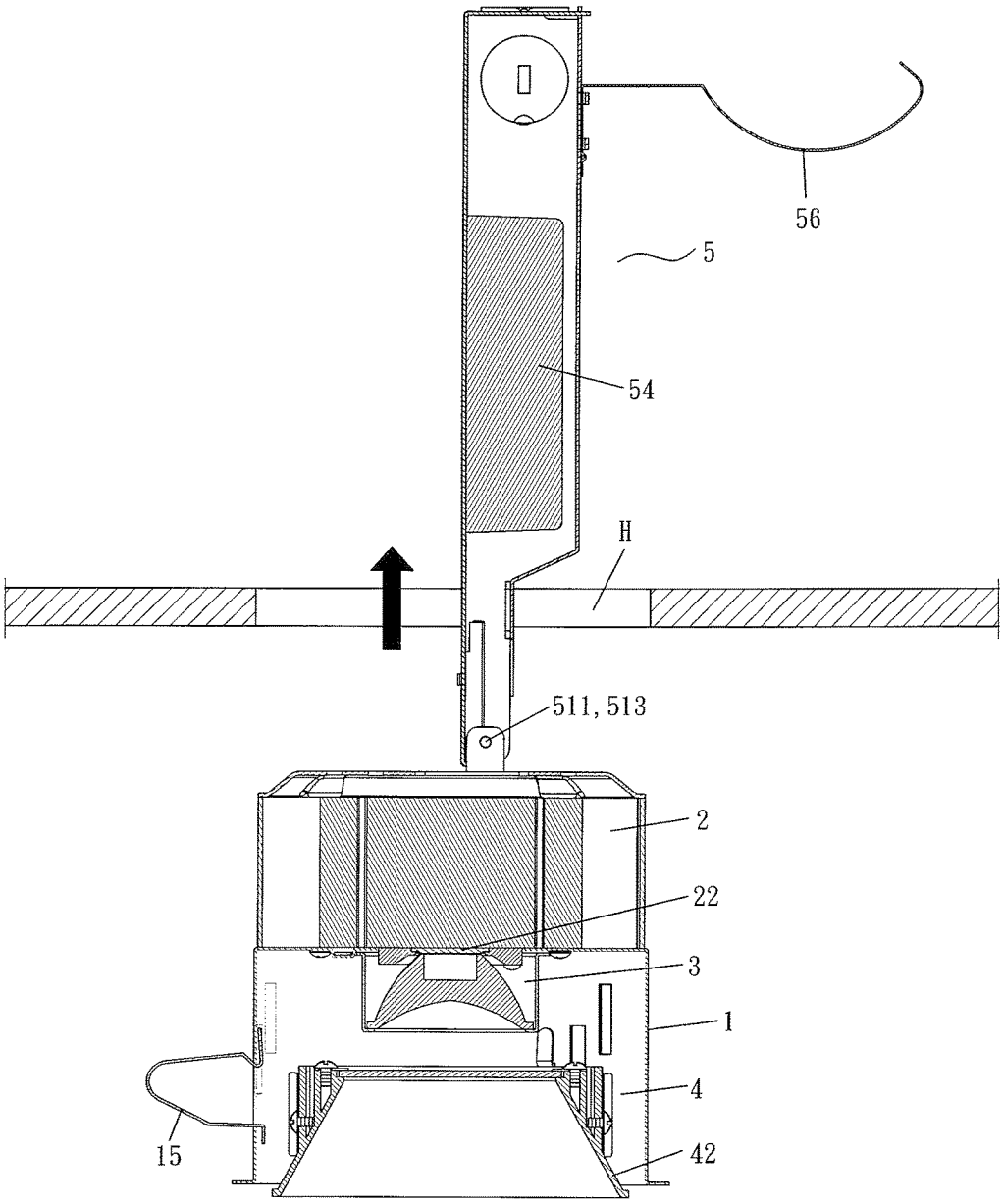
FIG. 7 is a schematic view of an LED downlight passed and installed into an installing hole reserved on the ceiling in accordance with the present invention.

The whole LED downlight 10 is commonly installed in an installing hole H reserved on the ceiling of a building as shown in FIG. 7. The installing hole H has a diameter preferably equal to or slightly smaller than the external diameter of the cylinder 1. The power supply device 5 is deflected upwardly by using the engaging hole 511 and the connecting element 513 as the axis, so that the power supply device 5 is situated at an erected status. The whole LED downlight 10 is passed in a bottom-to-top direction from the power supply device 5 into the installing hole H. During the process, the elastic plate 15 of the cylinder 1 and the support bracket 56 of the power supply device 5 are deflected and deformed to dodge into the installing hole H. After the cylinder 1 is latched and engaged with the installing hole H, the power supply device 5 will be deflected downwardly to resume its original position due to gravity. In the meantime, the support bracket 56 inside the ceiling will touch the ceiling downwardly, so that the power supply device 5 will stay in a transverse direction and prevent the whole LED downlight 10 from displacing due to gravity. Since the power supply device 5 is connected to the power supply in advance (or may be connected after the assembling process), the LED light source 22 can project light downwardly as long as power is supplied into the power supply device 5 and the drive power supply 54 is operated. When the downwardly projected light passes through a light diverging element (either the lens 32*a* or the reflective cup 32*b*), the range of light will be scattered and broadened further. When the light passes downwardly through the reflector 42 of the cover assembly 4, the range of light will be scattered further, so that a large area of light can be projected onto the space below.

As our living environment becomes increasingly better and more diversified, the ceiling may not be made of a sheet material, or the ceiling no longer exists in a home environment with simple style or industrial style, not mentioning the reservation for the installing holes. In situations like these, a bracket assembly is provided for installing the LED downlight 10 of the present invention.

Figure 8:
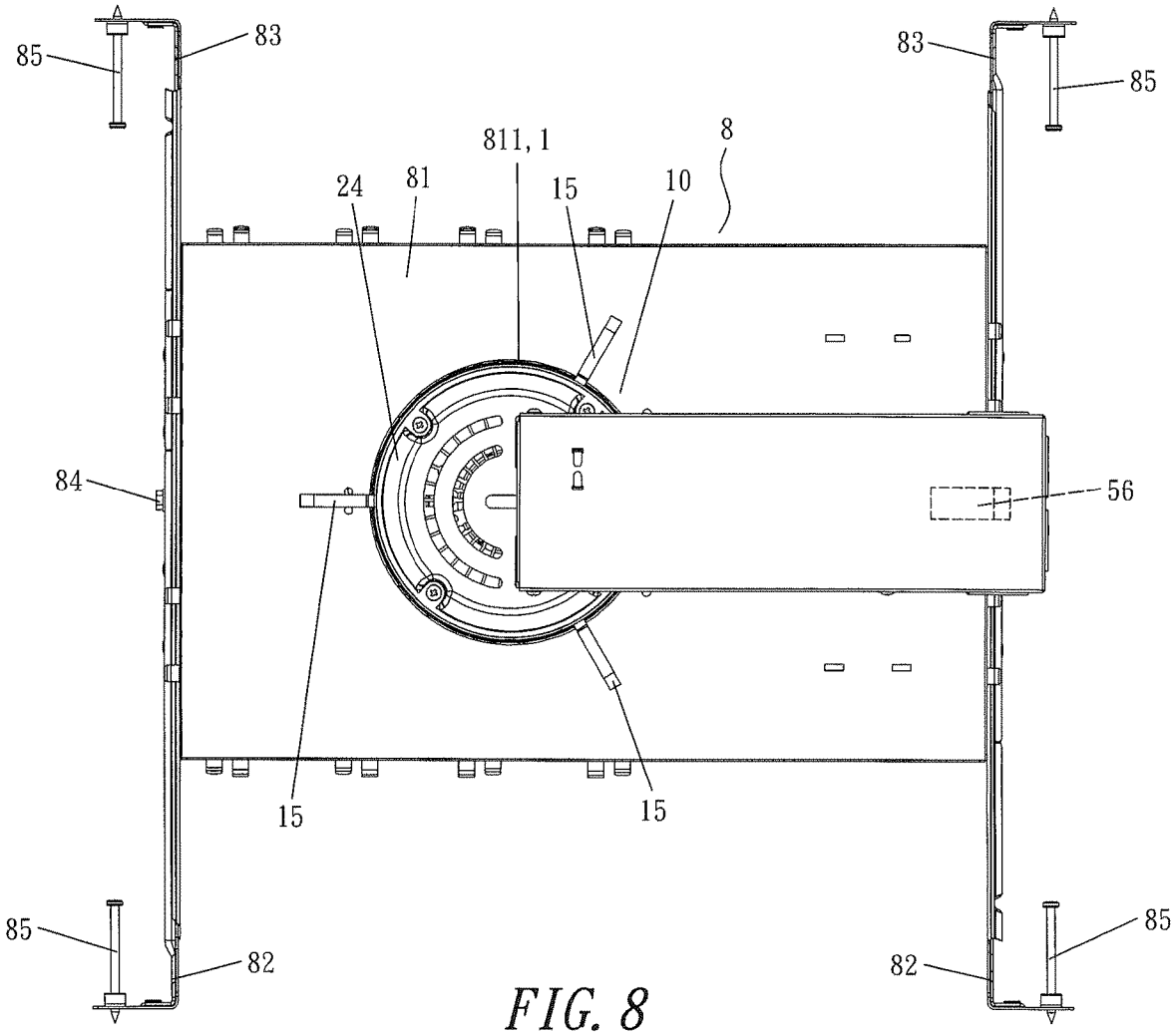
FIG. 8 is a top view of an LED downlight installed onto a first bracket assembly in accordance with the present invention.
Figure 9:
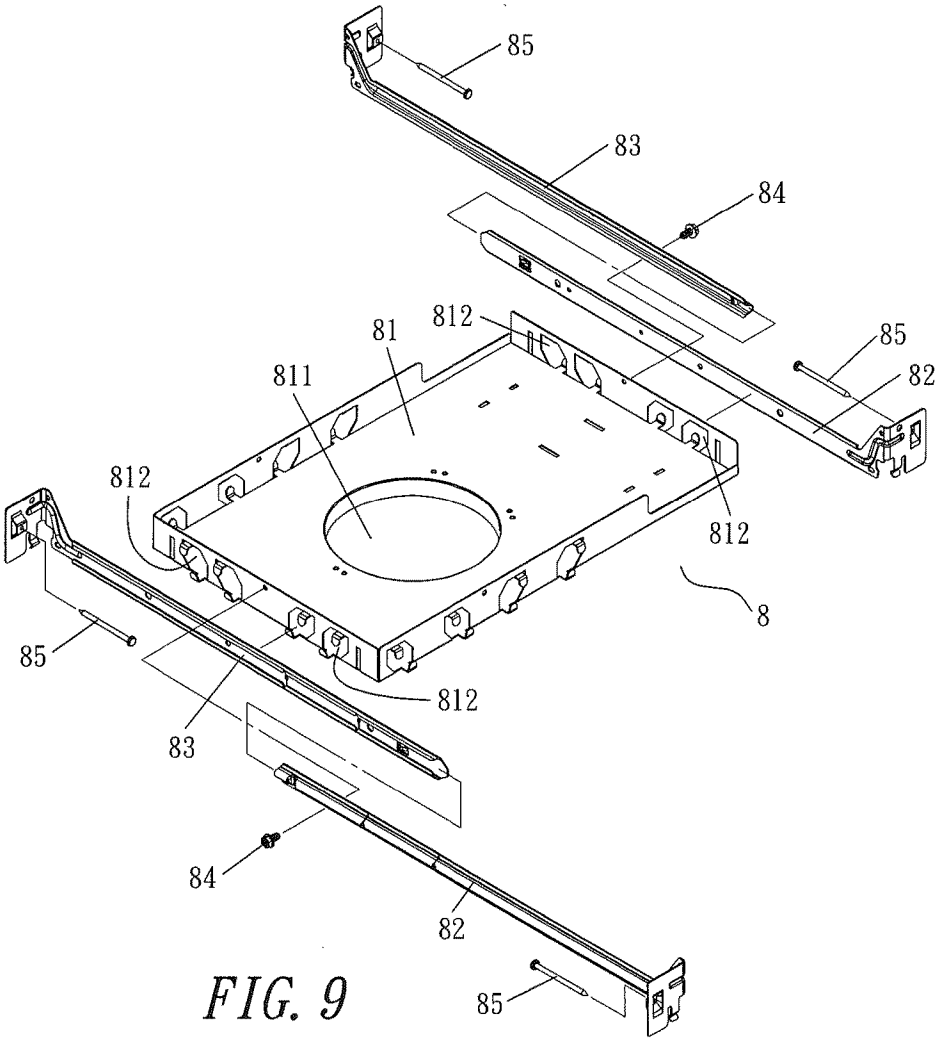
FIG. 9 is an exploded view of a first bracket assembly of the present invention.

With reference to FIGS. 8 and 9, the LED downlight 10 of the present invention may be installed onto a first bracket assembly 8. The first bracket assembly 8 comprises a fixed board 81, a male slider 82, a female slider 83 and a positioning bolt 84. The fixed board 81 is a flat object with a penetrating hole 811 formed thereon and provided for installing the cylinder 1 of the LED downlight 10 into the penetrating hole 811. The elastic plate 15 of the cylinder 1 is latched to the fixed board 81, and the support bracket 56 of the power supply device 5 abuts the fixed board 81 downwardly, so that the whole LED downlight 10 is securely installed onto the fixed board 81. Both sides of the fixed board 81 have a plurality of slots 812. The female slider 83 is inserted into the slots 821 on both sides of the fixed board 81 from an end, and the male slider 82 is inserted from the other end into the corresponding female slider 83, so that the male slider 82 and the female slider 83 can be moved or stretched with respect to each other to adjust and select an appropriate total length. Then, the positioning bolt 84 is passed through the male slider 82 and the female slider 83 and locked and positioned with the fixed board 81 to limit the relative positions of the fixed board 81, the male slider 82 and the female slider 83. If the first bracket assembly 8 is installed to a wood-structured cross beam, nails 85 may be used to fix an end of the male slider 82 and the female slider 83 to the cross beam. If the first bracket assembly 8 is installed to a ceiling with a keel, an end of the male slider 82 and the female slider 83 may be latched to a fixed slot directly. A specific total length can be stretched when the male slider 82 and the female slider 83 are combined with each other, so that users can adjust the male slider 82 and the female slider 83 to select an appropriate total length according to the actual needs, and so that then the users use the positioning bolt 84 for locking. If the installation space is smaller than the total length, the male slider 82 and the female slider 83 may be bent and broken at a specified pressing mark to shorten the total length in order to fit a small space.

Figure 10:
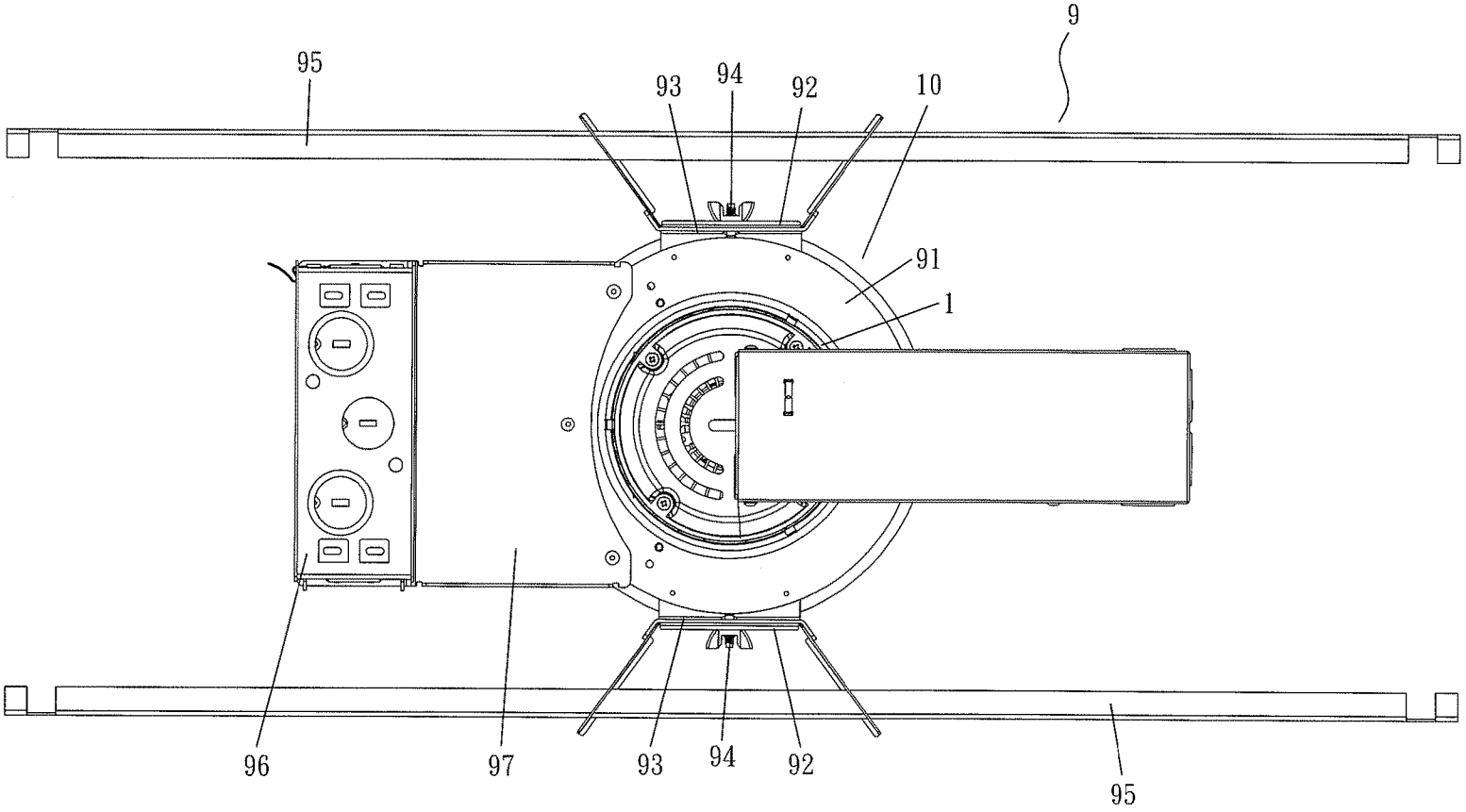
FIG. 10 is a top view of an LED downlight installed onto a second bracket assembly in accordance with the present invention.
Figure 11:
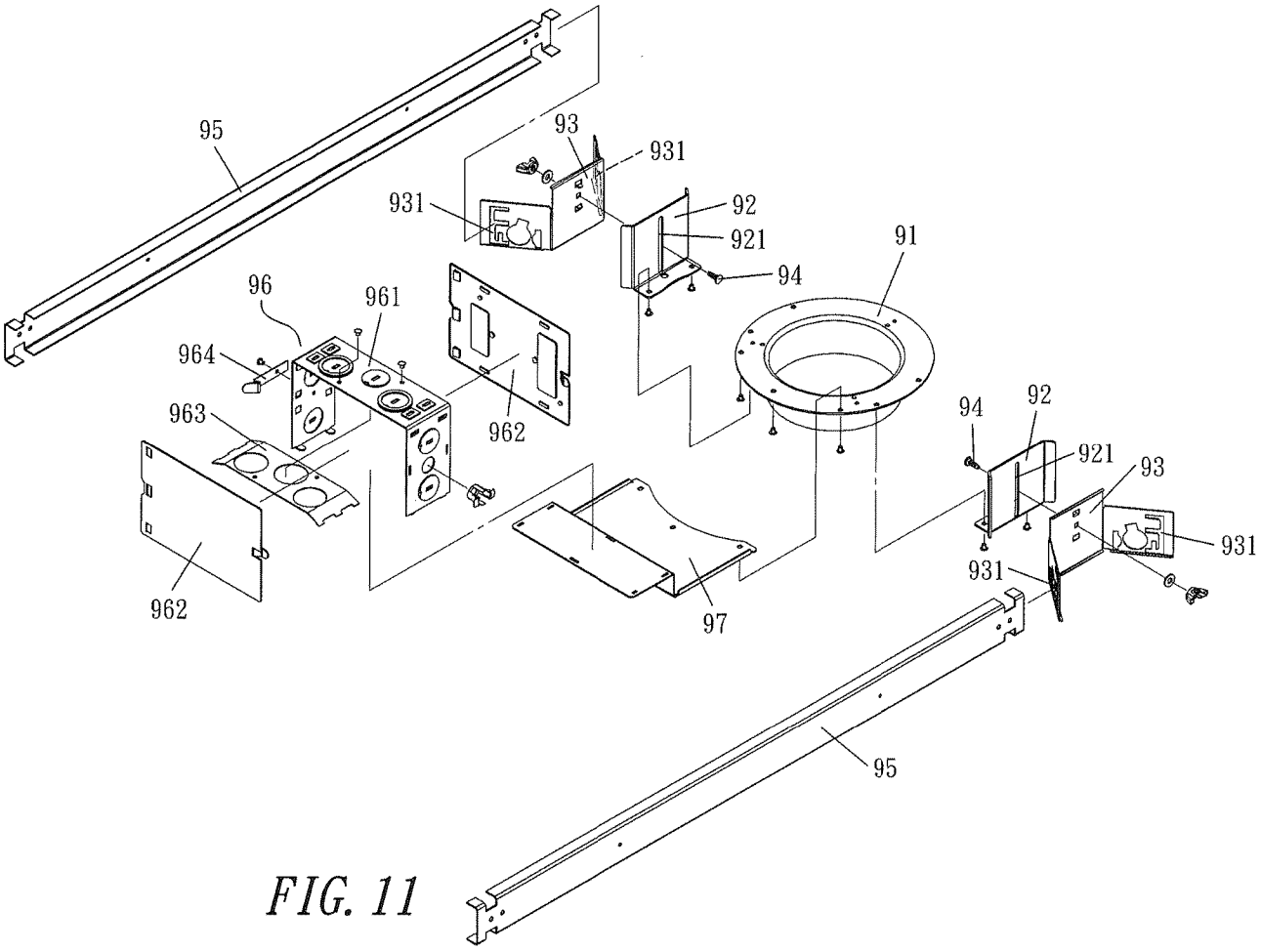
FIG. 11 is an exploded view of a second bracket assembly of the present invention.

In a commercial lighting application, the LED downlight 10 of the present invention may be installed onto a second bracket assembly 9. With reference to FIGS. 10 and 11, the second bracket assembly 9 comprises a fixing ring 91, a shelf plate 92, an elastic plate 93, a positioning bolt 94, a slider 95, a junction box 96 and a connecting plate 97. During assembling, a root portion of the shelf plate 92 is pivotally coupled to the two opposite sides of the fixing ring 91, so that a plate body of the shelf plate 92 is situated in an erected status. The plate body of the shelf plate 92 has a longitudinal groove 921 formed thereon, and the positioning bolt 94 is passed and installed into the longitudinal groove 921 to lock and fix the plate body of the elastic plate 93 to an inner side of the plate body of the shelf plate 92. A high/low position in the longitudinal groove 921 may be adjusted. Both sides of each elastic plate 93 have an outwardly extended oblique wing plate, and each oblique wing plate has a slot 931 formed thereon. The slider 95 is passed through the slot 931 formed on the oblique wing plate of the same elastic plate 93, and the junction box 96 is fixed to the fixing ring 91 by the connecting plate 97, to install the LED downlight 10 of the present invention into the fixing ring 91. The elastic plate 15 extending out from the mounting hole 14 of the cylinder 1 is provided for latching the fixing ring 91.

In FIG. 11, the junction box 96 comprises a box body 961, a side plate 962, a wire snapping plate 963 and an elastic plate 964. The box body 961 is pivotally coupled to the connecting plate 97, and the wire snapping plate 963 is installed into the box body 961. The side plate 962 is installed to the front and back sides of the box body 961. A latch plate on a side of the side plate 962 is pressed into a latching hole formed on a side of the box body 961 to achieve the latching effect, and the other end of the side plate 962 is latched tightly to a side of the box body 961 by the elastic plate 964.

The LED downlight 10 of the present invention is supported on the ceiling keel by the slider 95 of the second bracket assembly 9 or nailed onto the cross beam, so that the LED downlight 10 can be moved on the slider 95. The oblique wing plate on both sides of the elastic plate 93 are compressed, so that the pressing force of the slot 931 of the oblique wing plate exerted on the slider 95 is reduced. The LED downlight 10 together with the junction box 96 may be moved to different positions along the slider 95. When the pressing force exerted on the oblique wing plates on both sides of the elastic plate 93 is released, the resilience of the elastic plate 93 resumes the original position to latch the slider 95, to fix the position of the LED downlight 10. If the positioning bolt 94 is loosened, the up and down positions of the shelf plate 92 together with the LED downlight 10 can be adjusted to fit the requirement of different ceiling thicknesses.

From the description above, the LED downlight 10 of the present invention has the features of simple structure and convenient installation. The first bracket assembly 8 may be used for home lighting, or the second bracket assembly 9 can be used for commercial lighting, to provide good adaptability. In addition, the lens 32*a* or the reflective cup 32*b* may be replaced to change a different light output angle in order to meet different requirements of the projected object. In addition, the LED light source 22 of different color temperatures can fulfill the color requirements of the projection, and different types of cover assemblies 4 are provided for a user's choice in order to install the LED downlight 10 at a specific position for lighting.

In summation of the description above, the present invention is novel and capable of achieving expected objectives and effects. While the invention has been described by means of specific embodiments, numerous modifications and variations could be made thereto by those skilled in the art without departing from the scope and spirit of the invention set forth in the claims.

What is claimed is:

1. A convenient-to-install LED downlight, comprising a cylinder, a light source device, a light diverging assembly, a cover assembly and a power supply device, wherein:

the cylinder is a downwardly covered cylindrical object having an inwardly hollow bottom to form a containing space, a center hole formed at a center of a top of the cylinder, two or more slots formed on an inner surface of the top of the cylinder and disposed around the center hole, and two or more mounting holes formed on an outer wall of the cylinder and provided for latching an elastic plate;

the light source device comprises a heat sink, an LED light source, a support frame and a top cover, wherein the heat sink is engaged with the top of the cylinder, wherein the LED light source is supported by the support frame and engaged with a bottom surface of the heat sink, wherein the LED light source stays in the center hole at the center of the top of the cylinder, wherein a top of the top cover has two erected engaging walls each having an engaging hole, and wherein the top cover is engaged with the heat sink;

the light diverging assembly comprises a fixed cylinder and a light diverging element, wherein a top and a bottom of the fixed cylinder are inwardly hollow to form a containing space, wherein a shield wall is reserved at a bottom periphery of the fixed cylinder, wherein two or more buckles are extendedly outwardly from an outer wall of the top of the fixed cylinder, wherein the light diverging element is contained in the containing space of the fixed cylinder, wherein the bottom periphery of the fixed cylinder abuts the shield wall, wherein the fixed cylinder is installed into the containing space of the cylinder, and wherein each buckle of the fixed cylinder is passed through a corresponding slot of the cylinder to define a latching connection;

the cover assembly comprises a fixing ring, a reflector and an elastic plate, wherein the fixing ring has a flat ring disk, a middle erected upwardly to form a vertical wall, and an interior penetrated to form a large through hole, wherein a support wall is formed at an external surface of the reflector, wherein a center of the reflector is penetrated to form a light output hole, wherein at least two opposite engaging walls are formed on the external surface of the reflector, wherein the elastic plate has a length and is locked onto one of the at least two opposite engaging walls, wherein the reflector is accommodated into a large through hole of the fixing ring, wherein the support wall supports a bottom edge of the vertical wall of the fixing ring, wherein both edges of the elastic plate are bent inwardly to abut the vertical wall of the fixing ring, wherein the cover assembly is inserted into the containing space of the cylinder, and wherein the joint between the flat ring disk of the fixing ring and the vertical wall is latched and fixed to a bottom edge of the cylinder; and the power supply device comprises a housing, a bottom cover, a drive power supply and a support bracket, wherein the housing is box-shaped, wherein a bottom surface of the housing is hollow, wherein a bottom of an end of the housing is partially withdrawn upwardly, wherein two sidewalls of the end of the housing have engaging holes for passing connecting elements to engage with the engaging holes of the two erected engaging walls of the top cover, wherein the bottom cover is engaged with the bottom surface of the housing, wherein the drive power supply is installed inside the housing, wherein the drive power supply is electrically coupled to the LED light source through an electric wire, wherein the support bracket is locked to a bottom surface of the bottom cover, wherein the power supply device is deflected upwardly by using the connecting elements engaged with the top cover as the axis, and wherein the power supply device is in an erected status with respect to the top cover.

2. The convenient-to-install LED downlight of claim 1, wherein the two or more mounting holes formed on the outer wall of the cylinder have at least two hole positions of different heights for selectively latching the elastic plate to a position of a different height.

3. The convenient-to-install LED downlight of claim 1, wherein the light diverging element is a lens or a reflective cup.

4. The convenient-to-install LED downlight of claim 1, wherein a top of the reflector is installed with a glass plate, wherein the glass plate is horizontally disposed at an opening of the top of the reflector and then locked onto the at least two engaging walls and a wall connected to the reflector by passing a group of locking elements through a group of pressing plates respectively to force the glass plate and the reflector to be engaged and positioned.

5. The convenient-to-install LED downlight of claim 4, wherein the fixing ring and the reflector are of any shape.

6. The convenient-to-install LED downlight of claim 1, wherein the power supply device further comprises a thermostat and a ground wire, wherein the thermostat is installed inside the housing, and wherein the ground wire is coupled to an outer wall of the housing.

7. The convenient-to-install LED downlight of claim 1, wherein the support bracket of the power supply device has a curved arc to enhance elasticity.

8. The convenient-to-install LED downlight of claim 7, wherein when the power supply device is deflected upwardly into the erected status, the convenient-to-install LED downlight is passed upwardly into an installing hole reserved in a ceiling, and the elastic plate and the support bracket of the power supply device are dodged into the installing hole due to deflection and deformation during the process, and wherein after the cylinder is engaged with the installing hole, the power supply device will be deflected downwardly to an original position due to gravity, while the support bracket inside the ceiling will downwardly touch the ceiling, with the power supply device staying in a transverse direction and preventing the convenient-to-install LED downlight from displacing by gravity.

9. The convenient-to-install LED downlight of claim 1 installed to a first bracket assembly, wherein the first bracket assembly comprises a fixed board, a male slider, a female slider and a positioning bolt, wherein a penetrating hole is formed on a surface of the fixed board and provided for installing the cylinder into the penetrating hole, wherein the elastic plate is extended outwardly to latch with the fixed board, wherein the support bracket of the power supply device abuts the fixed board, wherein a slot is formed on both side edges of the fixed board separately, wherein the female slider is inserted from an end into the slots on the both side edges of the fixed board, wherein the male slider is inserted from another end into the female slider, wherein the male slider and the female slider move and stretch with respect to each other to adjust and select an appropriate total length, and wherein after the positioning bolt is passed through the male slider and the female slider, the positioning bolt is locked and fixed to the fixed board to limit a relative position among the fixed board, the male slider and the female slider.

10. The convenient-to-install LED downlight of claim 1 installed to a second bracket assembly, wherein the second bracket assembly comprises a fixing ring, a shelf plate, an elastic plate, a positioning bolt, a slider, a junction box and a connecting plate, wherein the shelf plate has a root portion engaged with two opposite sides of the fixing ring separately, wherein a plate body of the shelf plate is in an erected status, wherein the plate body of the shelf plate has a longitudinal groove formed thereon, wherein the positioning bolt is passed and installed into the longitudinal groove to lock a plate body of the elastic plate to the plate body of the shelf plate, wherein a high/low position in the longitudinal groove is adjustable, wherein both sides of the elastic plate of the second bracket assembly have an outwardly extended oblique wing plate, wherein each oblique wing plate has a slot formed thereon, wherein the slider is passed through the slot formed on the oblique wing plate of a same elastic plate of the second bracket assembly, wherein the junction box is fixed with the fixing ring by the connecting plate, wherein the convenient-to-install LED downlight is installed in the fixing ring, and wherein the elastic plate of the second bracket assembly extending out from the two or more mounting holes of the cylinder is latched with the fixing ring.

11. The convenient-to-install LED downlight of claim 10, wherein the junction box comprises a box body, a side plate, a wire snapping plate and an elastic plate, wherein the box body is engaged with the connecting plate, wherein the wire snapping plate is installed inside the box body, wherein the side plate is installed on front and rear sides of the box body, wherein a latch plate of a side of the side plate abuts a latch hole on a side of the box body to achieve a latching effect, and wherein another side of the side plate is latched to a side surface of the box body by the elastic plate of the second bracket assembly.

12. The convenient-to-install LED downlight of claim 1, wherein the fixing ring and the reflector are of any shape.

13. The convenient-to-install LED downlight of claim 1, wherein when the power supply device is deflected upwardly into the erected status, the convenient-to-install LED downlight is passed upwardly into an installing hole reserved in a ceiling, and the elastic plate and the support bracket of the power supply device are dodged into the installing hole due to deflection and deformation during the process, and wherein after the cylinder is engaged with the installing hole, the power supply device will be deflected downwardly to an original position due to gravity, while the support bracket inside the ceiling will downwardly touch the ceiling, with the power supply device staying in a transverse direction and preventing the convenient-to-install LED downlight from displacing by gravity.

* * * * *